United States Patent [19]

McConnell, Jr.

[11] Patent Number: 4,749,136

[45] Date of Patent: Jun. 7, 1988

[54] JAW CRUSHING APPARATUS

[75] Inventor: David P. McConnell, Jr., Mesa, Ariz.

[73] Assignee: Laurence V. Turley, Gilbert, Ariz.

[21] Appl. No.: 823,309

[22] Filed: Jan. 28, 1986

[51] Int. Cl.[4] ..... B02C 1/06

[52] U.S. Cl. ..... 241/266; 241/290

[58] Field of Search ..... 241/208, 210, 214, 215, 241/218, 101.2, 175, 290, 264–269, 300

[56] References Cited

U.S. PATENT DOCUMENTS

| | | | |
|---|---|---|---|
| 1,247,701 | 11/1917 | Michaelsen | 241/266 X |
| 3,079,096 | 2/1963 | McConnell | 241/266 X |
| 3,774,855 | 11/1973 | Wolf | 241/175 X |

FOREIGN PATENT DOCUMENTS

| | | | |
|---|---|---|---|
| 0081203 | 6/1983 | European Pat. Off. | 241/268 |

*Primary Examiner*—Mark Rosenbaum

*Attorney, Agent, or Firm*—John A. Bucher

[57] ABSTRACT

A jaw crusher is disclosed wherein opposed jaws converge downwardly to form a passage for material to be crushed, the jaws being supported on a frame structure by resilient floating mounts connected in series with each other and between the respective jaws and the frame structure. Each resilient floating mount preferably includes a wheel and pneumatic tire arranged coaxially within a relatively larger cylindrical track. Balanced eccentric masses are supported on each jaw for uniformly driving them in oscillatory vibration. The jaws are configured so that when lower portions of the jaws are generally parallel in order to achieve fine crushing, the upper jaw portions form a converging angle of approximately seven to sixteen degrees in order to achieve enhanced crushing particularly in combination with the balanced eccentric masses and the series connected resilient floating mounts.

10 Claims, 4 Drawing Sheets

JAW CRUSHING APPARATUS

FIELD OF THE INVENTION

The present invention relates to rock crushing machines and more particularly to such machines wherein oscillatory vibration is produced between opposed jaws by means of eccentric masses or the like.

BACKGROUND OF THE INVENTION

U.S. Pat. No. 3,079,096, entitled "Crushing Apparatus" issued Feb. 26, 1963 to David P. McConnell, father of the inventor herein. The crusher described and claimed in the above noted patent is believed to be particularly representative of the prior art with respect to the present invention and is accordingly discussed in greater detail below. At the same time, the jaw crusher of the present invention includes certain features in common with that of the above noted patent. Accordingly, U.S. Pat. No. 3,079,096 is incorporated herein as though set forth in its entirety in order to provide a more complete understanding of the present invention, particularly as to those features which are also common to the above patent.

Referring now to the incorporated reference, it disclosed a jaw crusher of the type generally referred to above wherein an eccentric mass was supported for rotation behind each of the opposed jaws. Substantial forces acting upon the jaws were absorbed by resilient means including wheels with pneumatic tires arranged in shoes or cylindrical tracks. In addition to absorbing tremendous shock loading on the jaws, the resilient tires also permitted the jaws to move away from each other as necessary when uncrushable material formed from hardened steel and the like entered between the jaws.

Accordingly, the jaw crusher of the reference was particularly effective in crushing material such as rock while preventing the jaws or other portions of the crusher from being damaged by uncrushable material passing between the jaws.

Other jaw crushers including vibratory jaw crushers with opposed jaws operated by rotating eccentric masses have also been disclosed. However, at least for purposes of the present invention, their apparatus is believed to be generally equivalent to that of the above reference.

Although the jaw crusher of the reference and similar jaw crushers in the prior art were very effective for their purpose, it has been found desirable to achieve certain improvements particularly in the area of increased crushing capacity, the ability to pass even larger uncrushable objects and the achievement of smoother and more uniform operation of the crusher both for contributing to increased capacity and also for assuring a long operating life, particularly for parts in the crusher subject to substantial shock loading.

Accordingly, there has been found to remain a need for a jaw crusher exhibiting improvements in accordance with the preceding discussion.

SUMMARY OF THE INVENTION

It is therefore an object of the present invention to provide a jaw crusher having opposed jaws wherein at least one of the jaws is floatingly supported by means including two resilient floating mounts connected in series with each other and for supporting the one jaw relative to a common frame structure for the crusher, the two series connected resilient floating mounts causing relative movement of the jaws in response to an eccentric mass and resulting in enhanced crushing capacity.

It is a further object of the invention to provide such a jaw crusher wherein at least one of two series connected resilient floating mounts comprises a wheel means arranged in a cylindrical track means, the other resilient floating mount providng a resilient base for an axle of the wheel means. Preferably, both of the series connected resilient floating mounts are formed by combinations of wheel means and cylindrical track means. Even more preferably, both wheel means comprises a pneumatic tire arranged for interaction with the cylindrical track means in order to provide the resiliency contemplated by the invention.

With such a combination, a number of important advantages are achieved for the jaw crusher of the invention. Initially, the two series connected resilient floating mounts permit either or both jaws to experience oscillatory vibration in response to an eccentric mass wherein each jaw is permitted to move outwardly further from the other jaw and to move in a greater upward stroke. With rotation of the eccentric masses for the two jaws being synchronized, the jaws thus attain an increased upper stroke. Accordingly, substantially greater amounts of rock or other material to be crushed are permitted to enter between the jaws and to be gripped by the jaws as they move toward each other in a downward stroke resulting from their oscillatory vibrating motion.

With each of the series connected resilient floating mounts comprising wheel means with a pneumatic tire, the possible stroke for each jaw is contributed to by the spacing between the pneumatic tires and the cylindrical tracks for each of the resilient floating mounts as well as the amount of compression experienced by both pneumatic tires.

In addition to increasing the crushing capacity of the apparatus, the increased stroke as described above also permits the jaws to move further apart from each other as necessary, for example, when uncrushable parts or material, usually hardened steel, accidentally enters between the jaws. Because of the greater stroke permitted between the jaws, the uncrushable parts are allowed to pass through the crusher without damage and with resulting continued operation of the jaw crusher.

In the following description, additional means are included within at least one of the resilient floating mounts for adjusting the nominal spacing between the jaws. Such adjustment can of course be employed for varying or controlling the size of crushed material passing through the apparatus.

It is yet another object of the invention to provide a crusher including opposed converging jaws operated with oscillatory vibrating movement relative to each other wherein at least one of the jaws has a hardened upper portion inclined relative to a hardened lower portion so that when the lower jaw portion is generally parallel with a lower adjacent portion of the opposed jaw, the upper jaw portion forms a converging angle with an adjacent upper portion of the opposed jaw of about seven to about sixteen degrees and more preferably from about eight to about ten degrees.

In operating such jaw crushers, it is commonly desirable to position the jaws so that their lower portions are generally parallel for a number of purposes, including the production of fine crushed product from the crusher. It has been found, in accordance with the present invention, that formation of the converging angle noted above causes the jaws to impinge rock or other material to be crushed in more parallel relation with each other and to produce enhanced crushing force on the material.

The converging angle formed between the jaws is a particularly important feature in combination with the series connected resilient floating mounts described above. With such a combination, the increased stroke for the jaws in combination with the angular relation of the converging jaws enables the jaws to exert greater crushing force on larger amounts of rock or other material in order to even further enhance crushing capacity of the apparatus.

With the converging configuration of the opposed jaws, it is further noted that the lower portions of either or both jaws may be removable or replaceable in order to make the apparatus more versatile.

It is an even further object of the invention to provide a crusher of the type including converging opposed jaws floatingly supported relative to a frame structure, oscillatory vibrating motion being imparted to either or both of the jaws by means of two spaced apart eccentric masses arranged upon a common shaft extending laterally across a back portion of a respective jaw, first, second and third bearing means being arranged at each end of the shaft and between the eccentric masses in order to achieve more uniform transfer of oscillatory and vibrating force from the eccentric masses to the respective jaw.

This feature of the invention is also particularly important in combination with the providing of series connected resilient floating mounts for the jaws and/or formation of the jaws in converging relation to form a preferred angle as discussed above. In connection with either or both of these features, the balanced arrangement of the eccentric masses causes more uniform transfer of force to the jaws in order to assist in achieving enhanced crushing capacity for the apparatus as well as to reduce unnecessary stress in various parts of the apparatus such as the common shaft supporting two eccentric masses upon either or both jaws.

Additional objects and advantages of the invention are described below with reference to the accompanying drawings or will be apparent to those skilled in the art from the drawings and following description.

DESCRIPTION OF THE PREFERRED EMBODIMENT

Figure 1:
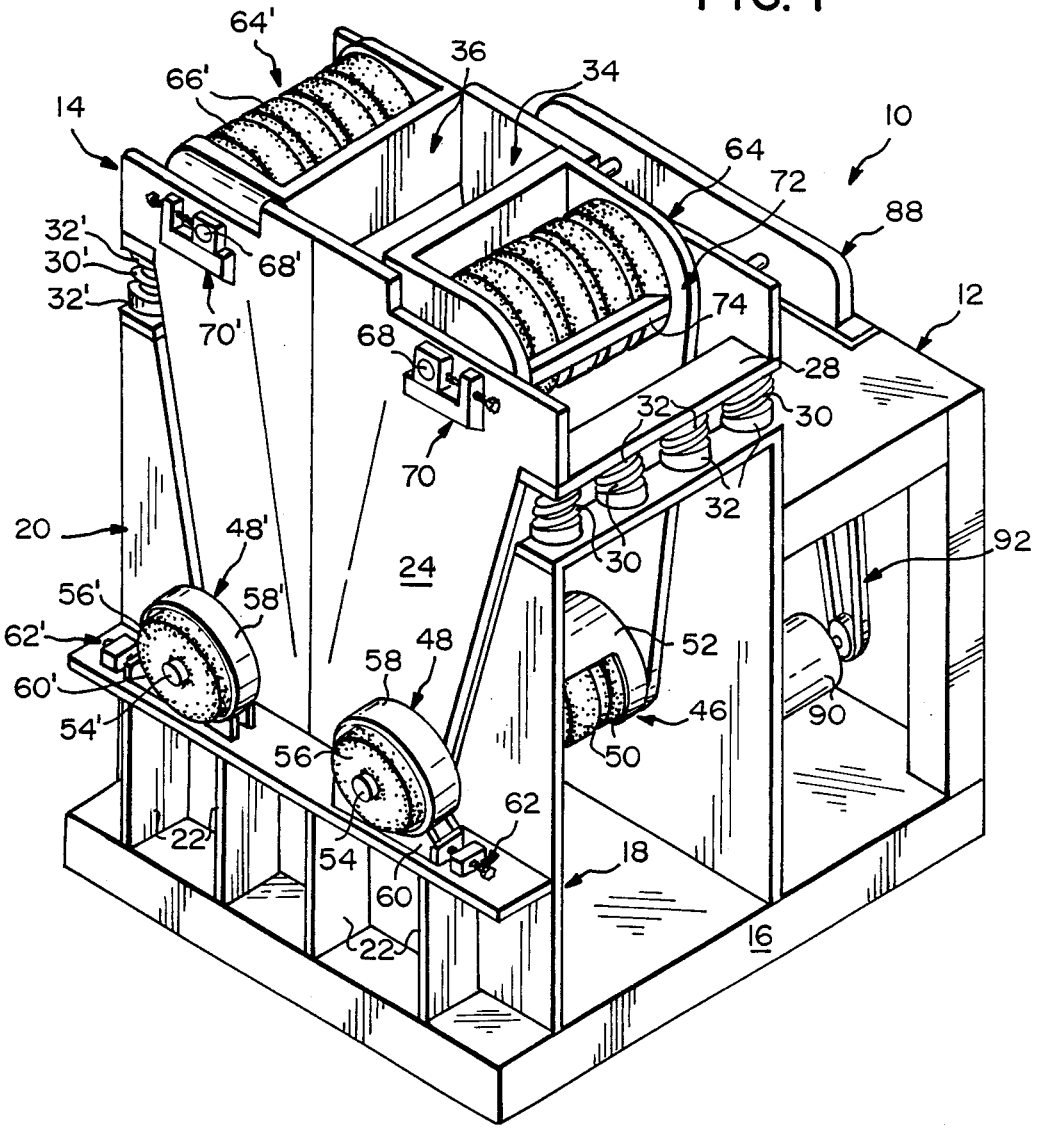
FIG. 1 is a perspective view of a jaw crusher constructed in accordance with the present invention.
Figure 2:
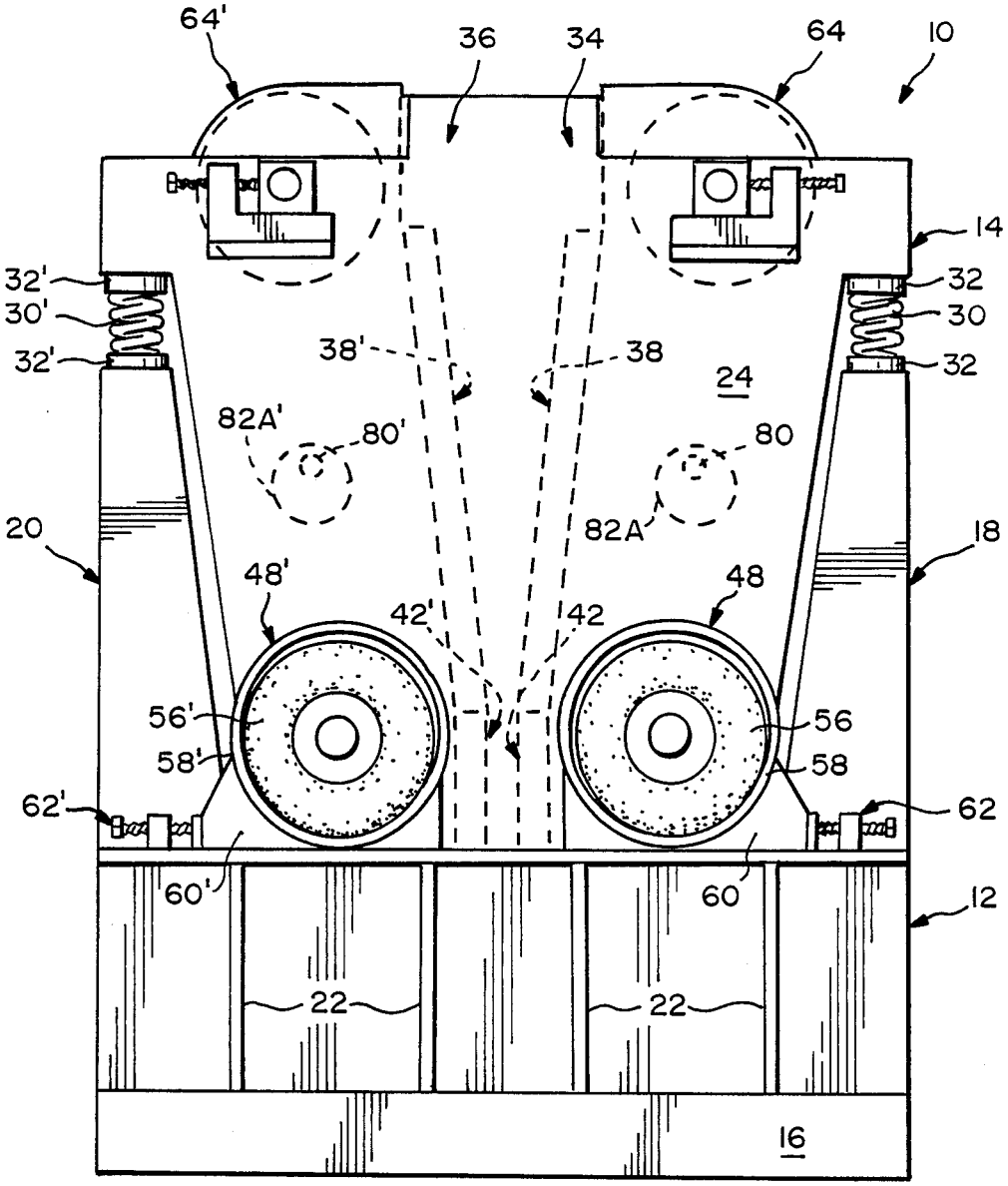
FIG. 2 is a side view, with parts shown in cross section, of the crusher of FIG. 1 in order to more clearly illustrate its construction in accordance with the invention.

A jaw crusher constructed according to the present invention is generally indicated at 10 in the drawings and includes a base frame assembly 12 and a fabricated floating frame structure 14. The base frame assembly includes a platform 16 with upright frame members 18 and 20 and reinforcing plates 22.

The floating frame 14 includes opposed upright side plates 24 and 26 rigidly interconnected by cross members 28.

The floating frame assembly 14 is resiliently supported upon the base frame 12 by a plurality of coiled springs 30 interposed between the upright frame members 18 and 20 of the base frame 12 and the cross members 28 of the floating frame assembly 14. The springs 30 are positioned relative to both members 18, 20 and 28 by means of retaining cups 32.

A pair of pressure jaws 34 and 36 are mounted on the floating frame assembly 14 in a manner described in greater detail below for allowing oscillating vibratory movement of jaws in synchronized relation with each other. The manner in which the jaws 34 and 36 are mounted upon the floating frame assembly 14 is of particular importance within the present invention because of the very substantial shock forces acting upon the jaws during operation of the crusher. In any event, it will be more apparent from the following description that in their oscillatory vibrating movement, the jaws experience an upward stroke where they move upwardly and away from each other followed by a downward stroke where the jaws move downwardly and toward each other. The upward and downward strokes of the jaws produce vibratory movement in order to develop crushing force on rocks or other material passing between the jaws.

Figure 4:
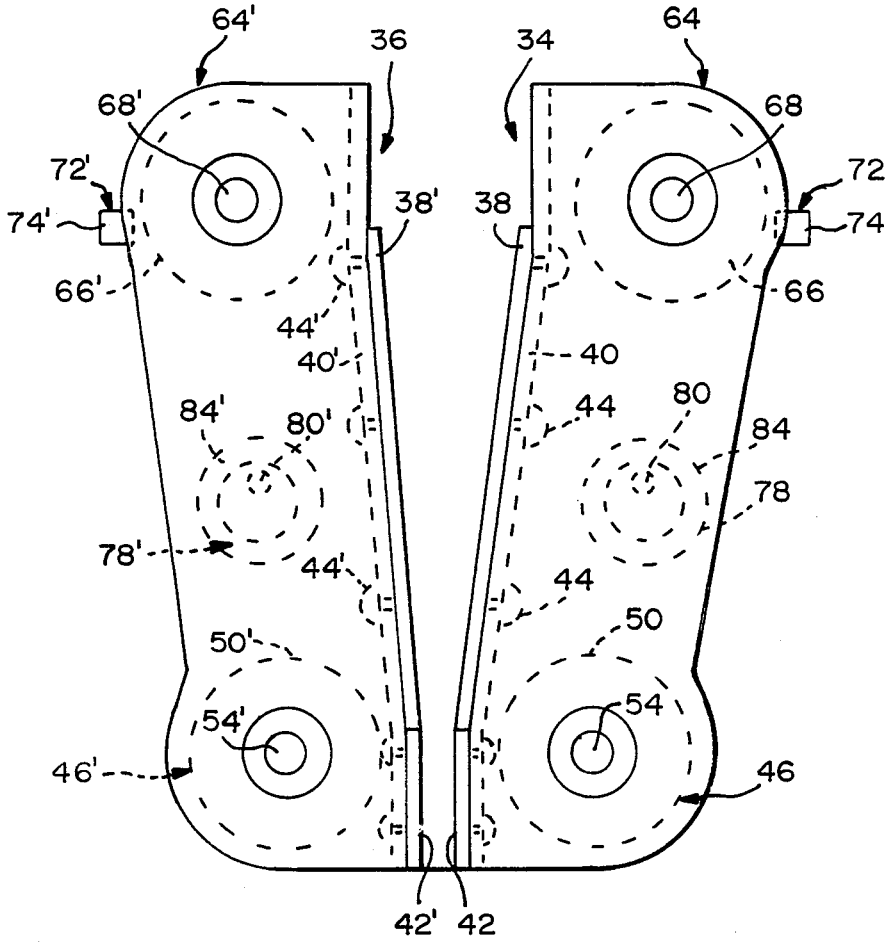
FIG. 4 is a fragmentary side view of the opposed jaws in the crusher to better illustrate their construction and configuration.

As noted above, the crusher jaws 34 and 36 are of substantially similar construction except that they are formed as mirror images to each other. Accordingly, the following description for the crusher jaw 34 also applies to the crusher jaw 36 with similar primed numerical labels being employed. Referring now particularly to FIG. 4, the crusher jaw 34 is formed with an upper hardened face plate 38 and a lower hardened face plate 42 which is substantially shorter in vertical dimension than the upper face plate 38. Both plates 38 and 42 are secured to a backing plate 40 by means of countersunk bolts or studs 44 in order to permit their removal or replacement on the jaw.

The angular relationship between the upper and lower face plates 38 and 42 on the crusher jaw 34 and the upper and lower face plates 38' and 42' on the jaw 36 is of particular importance within the present invention in order to achieve more effective crushing action on rocks or other material passing between the jaws.

Generally, it is desirable for the lower face plates 42 and 42' to be substantially parallel with each other, for example, when fine crushing is desired within the apparatus 10. At the same time, it has been found desirable to form a converging angle of generally about seven to about sixteen degrees between the upper face plates 38 and 38' for a number of reasons discussed immediately below. Preferably, the jaws 34 and 36 are configured so that the converging angle between the upper face plates 38 and 38' is about eight to ten degrees.

Some variation in this converging angle may occur during oscillatory vibrating movement of the jaws in the manner described below. However, if the converging angle is formed between the jaws 34 and 36 when they are at rest, generally the same angle will be maintained throughout the crushing operation.

Initially, the converging angle between the upper face plates 38 and 38' is selected so that the upper face plates are almost parallel with each other as the jaws 34 and 36 move outwardly and upwardly for engaging rocks or other material to be crushed. Because of the nearly parallel arrangement between the upper face plates 38 and 38', they apply greater crushing force to rocks falling between them. At the same time, the nearly parallel relationship of the upper plates allows them to more firmly grip the rocks and prevents the rocks from being forced upwardly away from the crushing plates 38 and 38' as the jaws 34 and 36 move toward each other in a downward stroke. The importance of this feature will be even more obvious when viewed in combination for the mounting arrangement for the jaws 34 and 36 as described in greater detail below. Limited convergence is of course necessary to allow material to be crushed to enter between the jaws.

In any event, the above advantages for the crusher could also be achieved if one of the jaws 34 and 36 were held stationary and even if its upper and lower plates were of parallel or unitary construction. The parallel relation between the lower face plates and the converging angle between the upper face plates would then be formed entirely in the other jaw. However, a preferred construction is illustrated in the drawings where both jaws 34 and 36 move in oscillating vibratory fashion while being mirror images of each other. With such an arrangement, the converging angle between the upper face plates 38 and 38', when the lower face plates 42 and 42' are generally parallel, is defined by forming an angle between the upper face plate and lower face plate on each jaw equal to about half of the preferred converging angle. Accordingly, if the converging angle between the upper face plates 38 and 38' is maintained in the range of eight to ten degrees, then each of the upper face plates, for example that indicated at 38, is arranged at an angle of four to five degrees with respect to the lower face plate 42.

Before leaving the construction of the jaws 34 and 36, it is again noted that the lower face plates 42 and 42' are replaceably secured to the backing plate of the respective jaw in order to facilitate ready replacement and also to permit removal of the lower face plate, for example, in applications where coarser sizing is desired for output from the crusher.

Also, the vertical length of the upper face plates 38 and 38' is substantially greater than the vertical length for corresponding upper face plates in the crusher of the above noted patent. This greater vertical length for the jaws is necessary, because of the more parallel relationship between the jaws, in order to produce the same spacing between the jaws at their upper ends and accept minimum dimensions of material to be crushed.

The crusher jaws 34 and 36 are supported for oscillatory vibrating movement in the floating frame structure 14 by two series connected resilient floating mounts 46 and 48 providing support for the crusher jaw 34 on the floating frame structure 14. A similar arrangement of series connected resilient floating mounts 46' and 48' support the other crusher jaw 36 relative to the floating frame structure 14. Since the mounts 46' and 48' are generally identical to those indicated at 46 and 48, except for being mirror images, the following description with respect to the mounts 46 and 48 also applies to them.

The first mount 46 comprises mounting means formed by members 50 of compressible and resilient material such as rubber. The resilient floating mount 46 also comprises another mounting means in the form of a rigid shoe or cylindrical track means 52 which is arranged to encompass and support the compressible members 50.

As illustrated in the drawings, the cylindrical track 52 is secured to the jaw 34 while the compressible members or wheels 50 are arranged upon a shaft or axle 54 which in turn is supported in resilient, floating relation on the floating frame structure 14 by the second resilient floating mount 48.

As illustrated in the drawings, the second resilient floating mount 48 also comprises mounting means formed by members 56 of compressible and resilient material such as rubber and additional mounting means in the form of rigid shoes or cylindrical tracks 58. As may be best seen in FIG. 3, the compressible members or tires 56 are mounted on opposite ends of the same shaft or axle 54 for the compressible members or wheels 50. A separate shoe or cylindrical track 58 encompasses each of the wheels or pneumatic tires 56 on opposite lateral sides of the respective jaw. Each of the shoes or cylindrical tracks 58 is rigidly supported by an adjusting block 60 which is positioned, for example to adjust spacing between the jaws, by means of an adjusting screw assembly 12 secured to the base frame assembly 12.

Figure 3:
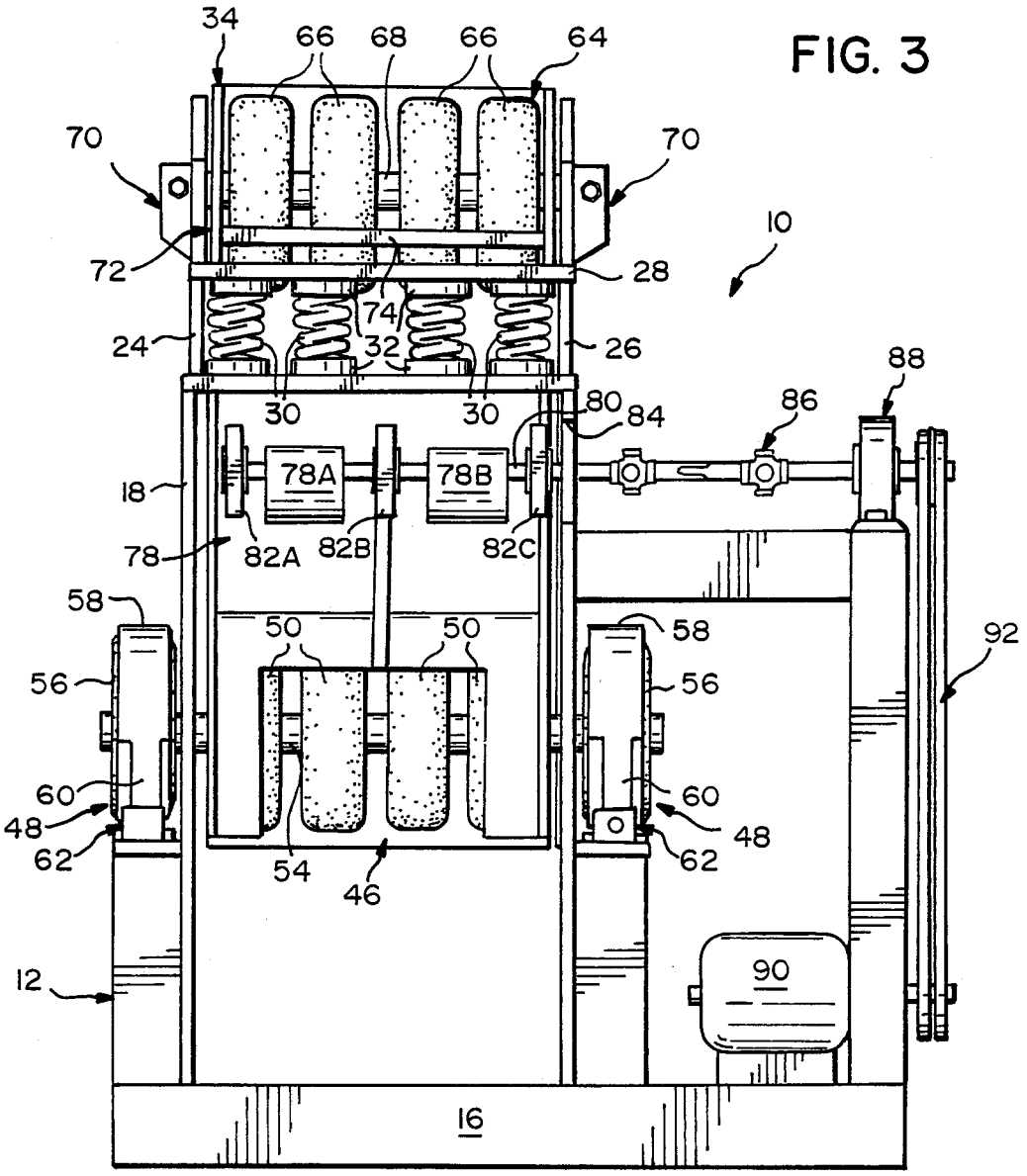
FIG. 3 is an end view taken from the right side of FIG. 2 in order to show additional features of the invention.

Thus, the combination of the first and second resilient floating mounts 46 and 48 together with the similar mounts 46' and 48' for the other jaw provide a number of advantages within the present invention. Initially, they extend the effective stroke of the jaws as described above for increasing crushing capacity of the apparatus 10. They also enable the jaws 34 and 36 to move further apart from each other as necessary for permitting uncrushable material or objects to pass between the jaws without damaging components of the crusher. In addition, as illustrated in FIG. 3, the adjusting screw assemblies 62 and 62' establish a reference point relative to the fixed base frame assembly 12 from which the spacing between the two jaws is established through the respective first and second floating mounts. In other words, as is also best seen in FIG. 3, the first and second resilient floating mounts for each jaw provide a series connection between the respective jaw and a respective portion of the fixed base frame assembly 12 rather than the floating frame structure 14 as in the patent noted above. Through this combination, better control is believed possible over the relative spacing and oscillating vibrational movement of the jaws.

It is again noted that oscillating vibrational travel of each jaw, for example the jaw 34, is permitted by radial spacing between the pneumatic tires 50 and the cylindrical track 52 together with spacing between the tires 56 and the cylindrical tracks 58 of the second resilient floating mount. This amount of travel is, in effect, a lost motion coupling permitting substantially greater movement for the jaws than the arrangement in the above noted patent. In addition to the spacing between the pneumatic tires and the cylindrical tracks, additional lost motion is also provided by relative compression experienced by the tires 50 and 56.

Finally, operation of the adjusting screw assemblies 62 and 62' in effect varies the nominal spacing between the jaws 34 and 36 in order to regulate the size of crushed material passing through the apparatus 10.

In order to permit desired oscillatory vibrational movement of each of the jaws 34 and 36, they are mounted at their lower ends in the manner described with the upper ends of both jaws being free from any direct coupling to either the fixed frame assembly 12 or the floating frame structure 14. Rather, resilient mountings are provided between the upper ends of the jaws and the floating frame structure 14 only for the purpose of limiting the movement of the jaws away from one another and to increase the rebound action of the jaws toward each other after they abut the resilient mounting means in their oscillatory vibrational travel. The resilient mounting means for the one jaw 34 is indicated generally at 64 and comprises multiple pneumatic rubber tires or resilient means 66 similar to the tires 50 and 56 described above. The tires 66 are rotatably mounted on a common shaft 68 supported in bearing blocks 70 adjustably mounted on the floating frame structure 14. Adjustment in the bearing blocks 70 thus shifts the tires 66 toward or away from the respective jaw 34. In operation, the tires 66 limit the movement of the jaw 34 away from the jaw 36 and increases rebound action of the jaw 34 toward the jaw 36 in the manner described above. Thus, adjustment of the blocks 70 can in effect change desired spacing between the upper ends of the jaws.

Restraining means 72 are provided for limiting movement of the jaw 34 toward the jaw 36. The restraining means 72 comprises a stop plate 74 secured to the jaw 34 so that the stop plate 74 acts against the tires 66 to limit inward travel of the jaw 34. With similar restraining means provided for both of the jaws 34 and 36, they are permitted to follow the oscillatory vibrational pattern described above while also maintaining spacing between their upper ends to form a feed passage for material to be crushed. This feature is of particular importance within the present design since the angular configuration of the jaws 34 and 36 as described above produces a tendency in the jaws to collapse toward each other when a rock or other material to be crushed is not passing between the jaws. Thus, within the apparatus of the present invention, the restraining means 72 and 72' for the jaws 34 and 36 maintain a feed passage through the crusher 10.

Each jaw, for example that indicated at 34, is also provided with means in the form of an eccentric means 78 for producing oscillating vibration of the two jaws 34 and 36 in unison toward and away from each other. As may be best seen in FIG. 3, the eccentric means 78 for the jaw 34 is formed by two separate eccentric masses 78A and 78B arranged in lateral spaced apart relation generally adjacent opposite sides of the jaw 34. The two eccentric masses 78A and 78B are mounted on a common shaft 80 which is supported upon the jaw 34 by three spaced apart bearings 82A, 82B and 82C arranged on opposite sides of the eccentric masses 78A and 78B and between the masses respectively.

The shaft 80 extends through a large opening 84 in the plate 24 of the floating frame structure 14 in order to avoid contact with the floating frame structure 14. Similar shafts respectively supporting eccentric masses on the jaws 34 and 36 are coupled through universal drive means such as that indicated at 86 with a common drive box 88 for achieving synchronous rotation of the eccentric masses generally in the same manner discussed in greater detail within the above noted patent. An electric motor 90 is connected with the drive box 88 through a pulley and belt arrangement 92 for producing synchronous drive of the eccentric masses on both of the jaws 34 and 36.

The arrangement of the two eccentric masses on each jaw provides balanced transmission of gyratory and vibrational forces to the respective jaw due in part to arrangement of eccentric masses on both lateral sides of the jaw and also because of the three bearings providing a more solid mount for the shaft supporting the masses upon the respective jaw. The balanced eccentric masses described above are of particular importance in combination with the preferred converging angle formed between the jaw faces as described above in order to further increase crushing force transferred to rocks or other material through the jaws.

The manner of operation for the apparatus 10 is believed obvious from the preceding description and also from the incorporated reference discussed above. However, operation is briefly summarized below in order to assure complete understanding of the apparatus 10 and particularly the novel features included within the apparatus according to the present invention.

In operation, the adjusting screw assemblies 62 and 62' are set to produce a predetermined spacing between the jaws 34 and 36. The motor 90 is then caused to produce oscillatory vibrational movement of the jaws through the eccentric masses arranged adjacent each of the jaws. At the same time, material to be crushed is introduced into the space between the jaws 34 and 36. As the material to be crushed passes downwardly between the jaws, the jaws follow the oscillatory vibrational pattern described above.

Because of the series connected resilient floating mounts, for example those indicated at 46 and 48 for the jaw 34, an increased stroke is produced in the jaws so that they engage greater amounts of the material to be crushed and thereby increase the crushing capacity of the apparatus 10. At the same time, the defined angle between the jaw faces causes the jaws to impact the material to be crushed at a preferred angle further increasing operating efficiency of the apparatus 10. The balanced arrangement of the eccentric masses on each of the jaws further assures more uniform transfer of oscillatory vibrational force through the jaws and into material to be crushed which is arranged laterally across the surfaces of the jaws 34 and 36.

In the event that uncrushable material such as hardened steel parts or the like pass between the jaws, the jaws are permitted to expand further apart from each other because of the lost motion coupling provided in each of the series connected, resilient floating mounts for the respective jaws.

Also, if there were an interruption in the supply of material to be crushed, for example, the jaws 34 and 36 are retained in spaced apart relation by the restraining means 72 and 72' so that the jaws remain properly positioned to permit introduction of additional feed between them.

Accordingly, there has been described a particularly novel jaw crusher for use in crushing rocks and other material.

Additional modifications and variations are believed obvious in addition to those specifically described above. Accordingly, the scope of the present invention is defined only by the following appended claims.

What is claimed is:

1. A crusher comprising a supporting frame structure, a pair of opposed downwardly converging crusher jaws defining therebetween a space for passage of material, means floatingly supporting one of the jaws relative to the frame structure and including first and second resilient floating mount means connected in series with each other and with the one jaw and the frame structure respectively, means for imparting oscillatory vibration to the one jaw, and means for supporting the other jaw in the frame structure for opposed crushing action relative to the one jaw whereby crushing capacity is enhanced by relative movement of the jaws permitted by the first and second series connected resilient floating mount means, the first resilient floating mount means comprising cylindrical track means connected to the one jaw and wheel means arranged generally coaxially within the cylindrical track means, the track means having an inside diameter substantially greater than the outside diameter of the wheel means, the wheel means including axle means, the second resilient floating mount means being interconnected between the axle and the frame structure.

2. The crusher of claim 1 wherein the second resilient floating mount means also comprises a similar combination of wheel means and cylindrical track means.

3. The crusher of claim 2 wherein each of the first and second wheel means comprises a pneumatic tire arranged for interaction with the respective cylindrical track means.

4. The crusher of claim 1 wherein the one jaw comprises upper and lower hardened jaw portions arranged in opposed relation to the other jaw, the upper and lower jaw portions being arranged at a preselected angle relative to each other so that, when the lower jaw portion is generally parallel with a lower adjacent portion of the other jaw, the upper jaw portion converges downwardly toward the lower jaw portion and inwardly toward an upper adjacent portion of the other jaw to form a converging angle of about seven to about sixteen degrees between the upper portion of the one jaw and the upper adjacent portion of the other jaw.

5. The crusher of claim 4 wherein the other jaw is a mirror image of the one jaw with similar means floatinglly supporting it relative to the frame structure and similar means for imparting oscillatory movement to it.

6. The crusher of claim 5 wherein the converging angle is from about eight to about ten degrees.

7. The crusher of claim 1 wherein the means for imparting oscillatory vibration to the one jaw comprises two spaced apart eccentric means arranged upon a common shaft extending laterally across a back portion of the jaw, first, second and third bearing means being respectively arranged at opposite ends of the common shaft and at a central portion of the shaft between the eccentric masses for supporting the eccentric masses on the jaw whereby oscillatory vibration is more uniformly imparted to lateral portions of the jaw with reduced stress in the common shaft.

8. The crusher of claim 7 wherein the other jaw is a mirror image of the one jaw with similar means floatingly supporting it relative to the frame structure and similar means for imparting oscillatory movement to it.

9. The crusher of claim 8 further comprising restraining means respectively coupled with an upper portion of each jaw and allowing oscillatory vibration of the respective jaw while maintaining the converging angle between the upper jaw portions for assuring a feed passage therebetween for material to be crushed.

10. A crusher comprising a supporting frame structure, a pair of opposed downwardly converging crusher jaws defining therebetween a space for passage of material, means floatingly supporting one of the jaws relative to the frame structure and including first and second resilient floating mount means connected in series with each other and with the one jaw and the frame structure respectively, means for imparting oscillatory vibration in the frame structure for opposed crushing action relative to the one jaw whereby crushing capacity is enhanced by increased relative movement of the jaws permitted by the first and second series connected resilient floating mount means, each of the first and second resilient floating mount means comprising a cylindrical track means and resilient wheel means arranged generally coaxially within the cylindrical track means, the cylindrical track means and resilient wheel means for each of the first and second resilient floating mount means being connected with each other and with the one jaw and the frame structure.

* * * * *